US005267701A

United States Patent [19]

Uchida et al.

[11] Patent Number: 5,267,701

[45] Date of Patent: Dec. 7, 1993

[54] PIECING METHOD AND APPARATUS FOR A DOUBLER

[75] Inventors: Hiroshi Uchida, Oumihachiman; Junichi Teranishi, Ohtsu, both of Japan

[73] Assignee: Murata Kikai Kabushiki Kaisha, Kyoto, Japan

[21] Appl. No.: 799,051

[22] Filed: Nov. 26, 1991

[30] Foreign Application Priority Data

Nov. 29, 1990 [JP] Japan ..... 2-127090[U]
Jan. 17, 1991 [JP] Japan ..... 3-4718[U]
Feb. 28, 1991 [JP] Japan ..... 3-3450

[51] Int. Cl.[5] ..... B65H 54/00

[52] U.S. Cl. ..... 242/42; 242/36; 57/350

[58] Field of Search ..... 242/42, 35.6 R, 35.6 E; 57/22, 261, 328

[56] References Cited

U.S. PATENT DOCUMENTS 4,943,009 7/1990 Gerstner-Stevens et al. ..... 242/42
4,964,268 10/1990 Stahlecker ..... 57/261
5,016,432 5/1991 Stahlecker ..... 57/261
5,044,148 9/1991 Fujiwara ..... 57/261 X
5,118,044 6/1992 Banba ..... 242/42 X

FOREIGN PATENT DOCUMENTS 1139824 6/1989 Japan ..... 57/328

*Primary Examiner*—Stanley N. Gilreath
*Attorney, Agent, or Firm*—Spensley Horn Jubas & Lubitz

[57] ABSTRACT

A piecing apparatus for a doubler provided with a processing robot which moves along units of a doubler. The piecing apparatus comprises two piecing devices, a suction mouth for sucking and holding a yarn on the side of a winding package to guide it toward the piecing device, a relay pipe for sucking and holding a yarn on the side of a feed package to guide it toward the piecing device, an upper yarn separating device for separating a doubled yarn on the side of each winding package guided toward the piecing device, and a lower yarn separating device for separating a yarn on the side of each feed package guide toward the piecing device.

2 Claims, 8 Drawing Sheets

PIECING METHOD AND APPARATUS FOR A DOUBLER

BACKGROUND OF THE INVENTION

1. Field of the Invention

This invention relates to a piecing method and apparatus for a doubler, and in particular to a piecing method and apparatus for introducing yarns on two feed packages for doubling and a doubled yarn on a winding package into piecing devices at the time of replacement of packages and at the time of end breakages in a doubler.

2. Prior Art

A doubler doubles two yarns delivered from two packages on the feed side into a single yarn and forms a winding package while traversing the yarn on a take-up tube.

In the past, piecing in a doubler has been done by an operator. More specifically, yarns drawn from two feed packages and a doubled yarn on the side of a winding package are joined and pieced together by an operator.

Piecing in a conventional doubler requires labor and time, which involves a problem.

An object of this invention is to automate piecing in a doubler.

SUMMARY OF THE INVENTION

For achieving the aforesaid object, a piecing apparatus for a doubler according to the present invention is provided with a processing robot, which moves along units of a doubler in which yarns of feed packages are guided directly below a tensor by a blow up nozzle provided on a support portion of each feed package and an auxiliary blow up nozzle provided on a balloon breaker, comprising two piecing devices, a suction mouth for sucking and holding a yarn on the side of a winding package to guide the yarn toward the piecing device, a relay pipe for sucking and holding a yarn on the side of a feed package to guide the yarn toward the piecing device, an upper yarn separating device for separating a doubled yarn on the side of each winding package guided toward the piecing device, and a lower yarn separating device for separating a yarn on the side of each feed package guide toward the piecing device.

In the piecing apparatus for a doubler constructed as described above, when the replacement of packages or yarn breakages occur, the processing robot moves to that unit, and the yarn on the side of the winding package is guided toward the piecing device by the suction mouth while the yarn on the side of the feed package is guided directly below the tensor by the blow up nozzle and the auxiliary blow up nozzle, and the yarn is guided from there toward the piecing device by the relay pipe. At that time, the respective yarns are separated to the left and to the right by the upper yarn separating device and the lower yarn separating device and guided into the respective piecing devices for piecing them together.

For achieving the aforesaid object, according to the piecing method of the present invention, when a yarn end is drawn from a winding package by a suction mouth for piecing, detection is made whether or not a yarn to be drawn is divided into two sections, and if it is divided, one yarn which precedes by traversing is cut, and the winding package is reversely rotated once, after which said drawing operation of yarn end is again carried out.

DETAILED DESCRIPTION OF PREFERRED EMBODIMENTS

Figure 1:
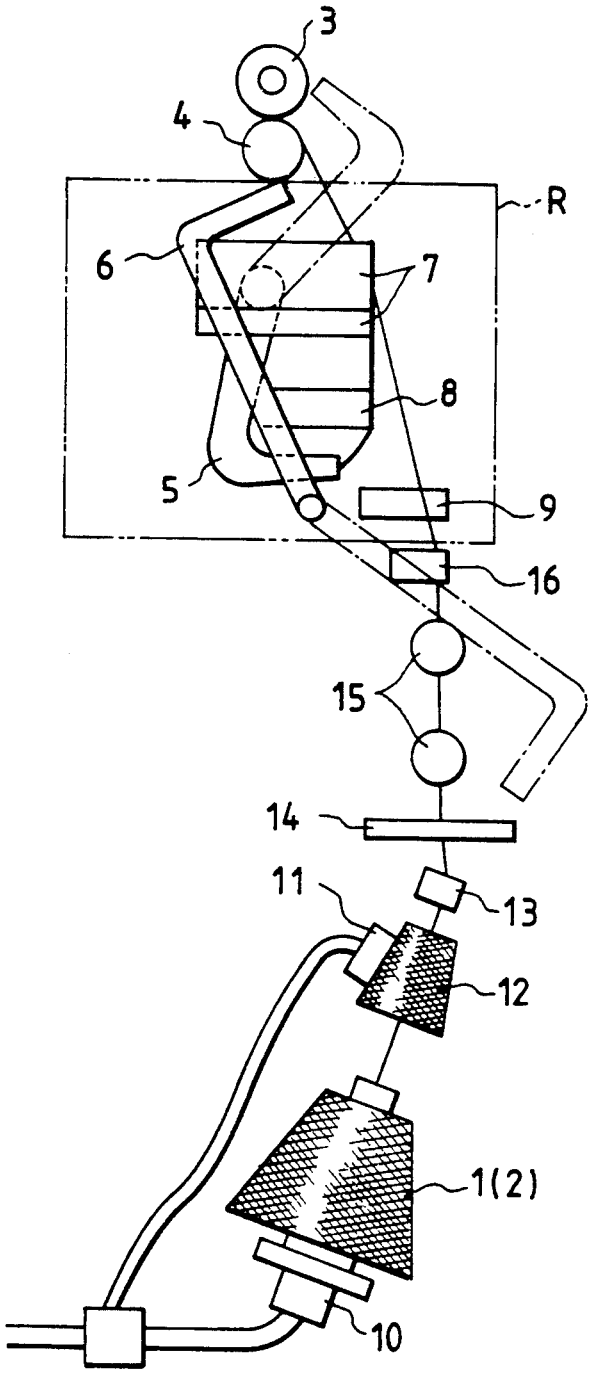
FIG. 1 is a side view of a piecing apparatus for a doubler according to this invention.

An embodiment of a piecing apparatus for a doubler according to this invention will be described with reference to the drawings.

First, a doubler will be described. A doubler has a construction similar to that of an automatic winder but is greatly different therefrom in that there are two feed packages. That is, in the basic construction of the doubler, as shown in FIGS. 1 and 2, yarns drawn from two feed packages 1 and 2 are moved to a tensor 15 via balloon breakers 12 and 12, where the yarns are joined and then wound on the package 3 while being traversed by a traversing drum 4.

Figure 2:
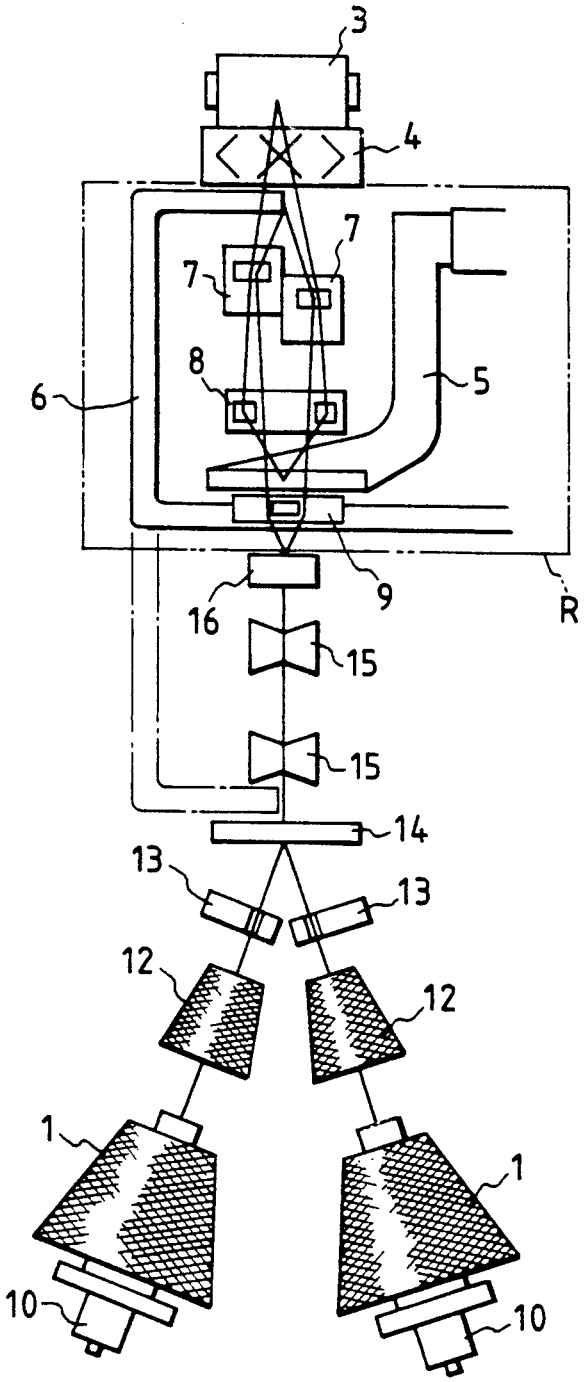
FIG. 2 is a front view of a piecing apparatus for a doubler according to the present invention.

A processing robot R is shown by contour lines in FIGS. 1 and 2. The robot R moves along units of a plurality of aligned doublers to doff a full winding package at a unit where the full package is produced, and to piece yarns of winding packages and yarn supply packages.

The processing robot R is provided with a suction mouth 5, a relay pipe 6, piecing devices 7 an upper yarn separating device 8 and a lower yarn separating device 9.

The piecing devices 7 are composed of a knotter, a splicer, etc. The left and right piecing devices 7 are vertically deviated so that pieced up sections of yarns are laterally deviated.

When at the time of replacement of packages or at the time of yarn breakages, yarn breakages are detected by yarn breakage sensors 13, the processing robot R travels to the relevant doubler unit. The suction mouth 5 sucks the yarn on the side of the winding package 3 at that unit to turn it downward and guide it toward the piecing devices 7.

At that time, the upper yarn separating device 8 is actuated to separate two yarns wound about the winding package 3 into left and right sections, each yarn being guided into a respective one of the piecing devices 7.

Figure 3:
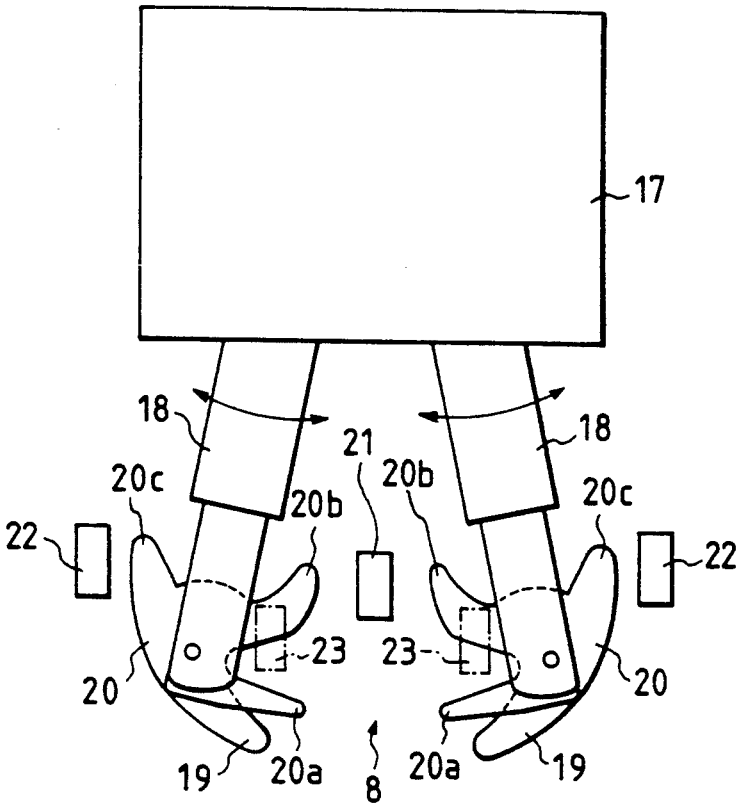
FIG. 3 is a plan view of an upper yarn separating device.

The upper yarn separating device 8 is composed, as shown in FIG. 3, of a box 17 housing an air cylinder, two left and right arms 18 and 18 supported on the box 17 and oscillated by an air cylinder, a fixed holding piece 19 secured to each arm 18, an oscillating and holding piece 20 supported for oscillation on each arm 18 and stoppers 21 and 22 for controlling oscillation thereof on both sides of the oscillating and holding piece 20, normally being in a standby state as shown in FIG. 3.

Each oscillating and holding piece 20 is composed of a projection 20*a* for holding an upper yarn in cooperation with the fixed holding piece 19, a projection 20*b* which contacts the inner stopper 21 when the arm 18 is oscillated inwardly, and a projection 20*c* which contacts the outer stopper 22 when the arm 18 is oscillated outwardly. When the upper yarn is guided toward the piecing devices 7 by the suction mouth 5, the arm 18 oscillates internally, and the projection 20*b* comes into contact with the stopper 21 and oscillates. In FIG. 3, the elements 20*a* are fixed holding plates and the elements 19 are contact plates which are joined to the elements 20*b* and 20*c*. The two yarns are initially in a position adjacent to the arrow 8 shown in FIG. 3. The arms 18 vibrate inwardly and, as a result of the contact plates 20*b* coming into direct contact with the stopper 21, the contact plates 19 close upon the corresponding fixed holding plates 20*a* and each of the two yarns is held separately by one of the contact plates 19 and the corresponding fixed holding plate 20*a*. Thereafter, the arms 18 are vibrating outwardly and the two yarns are separated, one yarn to the right and the other yarn to the left. After that, the contact plates 20*c* come into direct contact with the stoppers 22. As a result, the contact plates 19 and the corresponding fixed holding plates 20*a* open, and the two yarns are separately released between the respective contact plates 19 and the fixed holding plates 20*a*. By the time the two yarns are separated and released between the contact plates 19 and the fixed holding plates 20*a*, a separator (not shown) may be joined to the two yarns in order to maintain the separation.

Blow up nozzles 10 for jetting compressed air from the bottom toward the bobbin hollow portions are connected to the yarn feed packages 1 and 2 of this doubler, whereby when a cone is replaced, the ends of yarns received in the bobbin hollow portions of the new yarn feed packages 1 and 2 are carried to the balloon breakers 12.

An auxiliary blow up nozzle 11 for jetting compressed air upwardly is opened internally of the balloon breaker 12 so that each lower yarn of the yarn feed package carried by the blow up nozzle 10 is blown up to the yarn guide 14.

A relay pipe 6 has two suction openings, which may be turned up and down between the feed packages 1 and 2 and the piecing device 7. When packages are replaced or when yarn breakages occur, the suction openings are turned toward the yarn feed packages 1 and 2 so that the suction openings assume positions upwardly of the yarn guide 14. At that position, when yarns on the yarn feed packages 1 and 2 carried by the auxiliary blow up nozzle 11 are suctioned, the relay pipe 6 turns upward while holding each lower yarn of the yarn feed package to guide the latter toward the piecing devices 7.

At this time, the lower yarn separating device 9 is actuated to separate each yarn on each yarn feed package to the left or to he right and each yarn is guided into one of the piecing devices 7.

Figure 4:
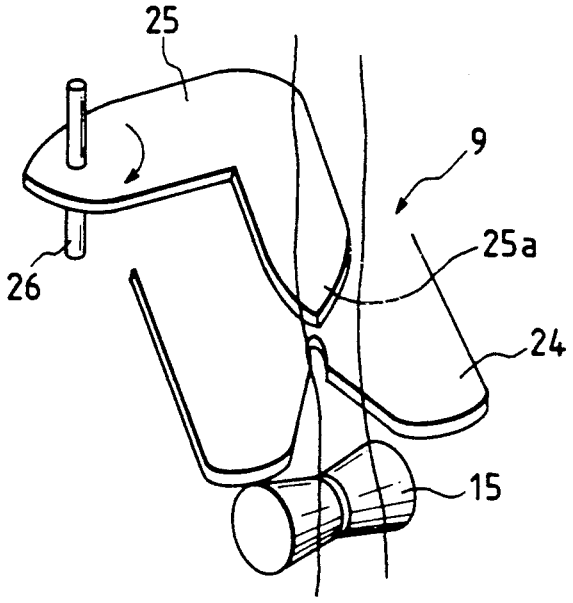
FIG. 4 is a perspective view of a lower yarn separating device.

The lower yarn separating device 9 is composed, as shown in FIG. 4, of a yarn guide 24 having a centrally depressed lower yarn receiving portion and an inverted L-shaped separate guide 25 supported pivotably about a vertical shaft 26 and having a sharp end 25*a* at a free end thereof, normally being in the standby state in FIG. 4.

When the lower yarn is guided toward the piecing device 7 by means of the relay pipe 6, a clearance between the members of the tensor 15 is opened so that the separate guide 25 is rotated in the direction of the arrow (FIG. 4) by a suitable drive means to cause the sharp end 25*a* to project between the lower yarns whose spacing is somewhat spread. As a result, the lower yarns are separated into left and right sections.

When yarns on the yarn feed packages 1 and 2 are introduced into the piecing devices 7 in the above-describe manner, they are joined with the yarns on the winding package 3 which are introduced into the piecing devices 7 by the suction mouth 5 to effect piecing.

Reference numeral 16 designates a yarn cutter, which is used at the time of piecing in a manner similarly to an automatic winder.

An embodiment of the invention constructed as described above has the following effect.

The piecing in the doubler can be done automatically (without requiring labor) and positively in a manner similar to that of an automatic winder. Accordingly, the doubler becomes fully automated.

In the case where a yarn end is drawn out of the winding package by the suction mouth, it is possible that two yarns may not be simultaneously drawn due to entanglement of fuzz, but instead one yarn may first be drawn and the winding package may be reversed once or several times, after which the other yarn is drawn. In a case where two yarns are drawn separated from each other and deviated by one or several periods as described above, that is, in a case where separation of yarns with period deviation occurs, two yarns are not permanently arranged into a single yarn, and piecing is carried out as it is, resulting in the formation of an abnormal winding package.

The present invention therefore provides a method for drawing a yarn in a doubler in which, when separation of yarns with period deviation occurs, this phenomenon is detected to overcome the same.

According to the present invention, when a yarn end is drawn from a winding package by a suction mouth for piecing, detection is made whether or not the drawn yarn is divided into two sections, and if it is divided, the leading yarn traversing section is cut, and the winding package is reversely rotated once, after which the yarn end drawing operation is again carried out.

First, when a yarn end is drawn out of a winding package to be pieced by a suction mouth, detection is made as to whether or not the yarn to be drawn is divided into two sections. If the yarn is not divided, then it is considered a normal yarn end and therefore piecing is continued.

However, when the yarn to be drawn is divided into two sections, so-called separation of yarns with period deviation occurs. Therefore, piecing is not carried out but first the leading yarn traversing section at the time of drawing is cut, and the winding package is reversed once. Thereby, the other yarn end is drawn by one rotation, and therefore, in the case where two yarns are deviated by one period, the period deviation is overcome and the two yarns are arranged into a single yarn.

In the case where the drawing operation of the yarn end by the suction mouth is again carried out and the yarn to be drawn is not divided into two sections, the piecing is continued. In the case where two yarns are still deviated in period, the drawing operation of yarn is carried out several times, and when the two yarns are arranged into a single yarn, the piecing is continued.

One embodiment of the piecing method of the present invention will be described in detail with reference to the accompanying drawings.

Figure 5:
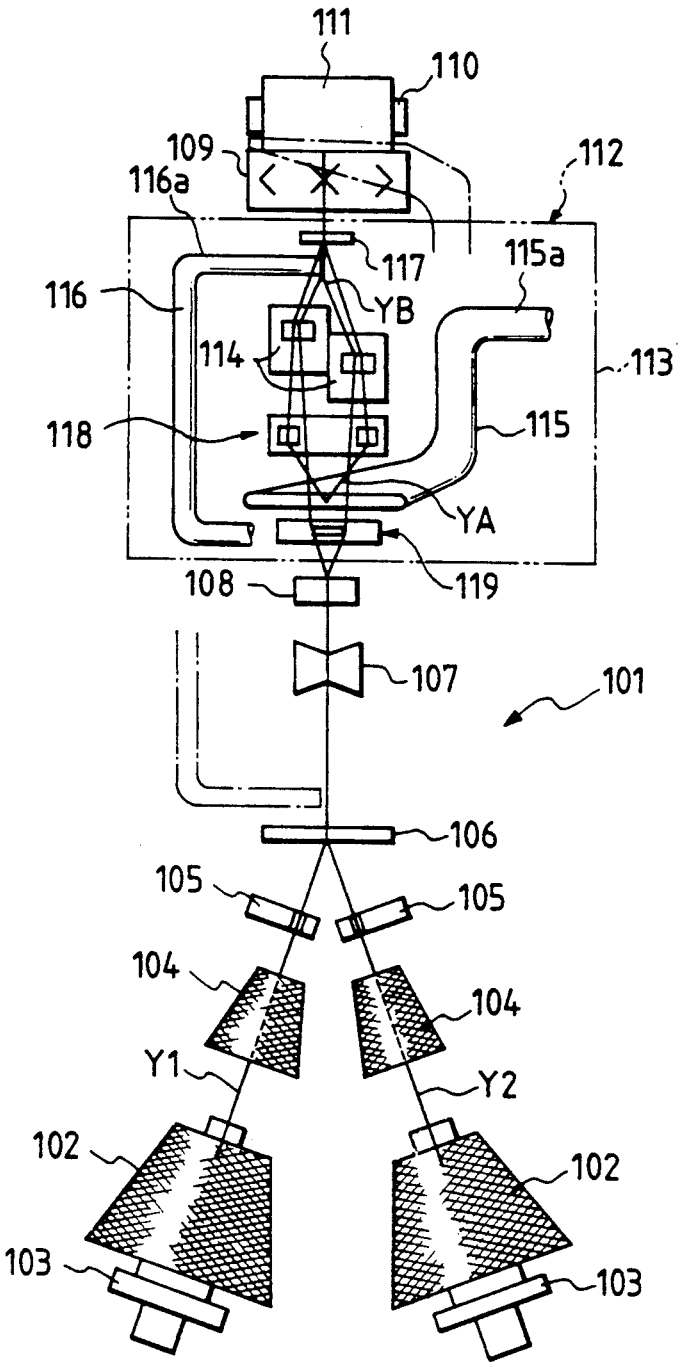
FIG. 5 is a front view showing a doubler to which a piecing method of the present invention is applied.

In FIG. 5, reference numeral 101 designates a doubler. At the lower part of the doubler 101, two yarn feed packages 102 are supported through package support members 103, respectively, and balloon breakers 104 and yarn sensors 105 are provided above the yarn feed packages 102, respectively. Above the yarn sensors 105 is provided a yarn guide 106 for upwardly collectively guiding two yarns Y1 and Y2 from the yarn feed packages 102, and above the yarn guide 106 are provided a tensor 107 for sandwiching the doubled yarn Y from opposite sides to apply a fixed tension thereto and a cutter 108 for cutting the yarn Y according to a yarn breakage signal from at least one yarn sensor 105.

On the other hand, a traverse drum 109 is horizontally provided above the cutter 108, and a take-up tube 110 is rotatably supported above the traverse drum 109 through a cradle arm (not shown). The take-up tube 110 is brought into contact with the traverse drum 109 to rotate it, and the doubled yarn Y is wound about the take-up tube 110 while being traversed by the traverse drum 109 to thereby form a package (a winding package) 111.

Between the cutter 108 and the traverse drum 109 is provided a piecing apparatus 112 which pieces a yarn end (also called upper yarn) TB on the side of the winding package cut by the cutter 108 and a yarn end (also called lower yarn) YA on the side of a yarn feed package. In case of carrying out piecing, yarn breakages occur in at least one yarn feed package 102, and therefore, feeding, replacement or the like is carried out and two yarns are guided in advance onto the yarn guide 106.

Although the piecing apparatus 112 may be individually provided on units of a plural number of doublers 101, it is to be noted that they may be provided on a carriage 113 which travels along the units as shown by the imaginary line for common use.

The piecing apparatus 112 is provided with two piecing sections 114 formed from a knotter, a splicer or the like. These piecing sections 114 are arranged deviated in position in the direction of yarn travel so that two pieced up sections are not overlaid. In the vicinity of the piecing sections 114, a suction mouth 115 and a relay pipe 116 are provided turnably about horizontal turning shafts 115*a* and 116*a*, respectively. The suction mouth 115 turns upwardly from the lower standby position to move close to the winding package 111. As the winding package 111 reverses, the suction mouth 115 sucks the yarn end YA, after which the suction mouth turns downward to draw the yarn end YA to guide it to the piecing sections 114. The relay pipe 116 turns downward from the upper standby position and moves close to the neighbourhood of the yarn guide 106 to suck the yarn end YB on the yarn feed side. Thereafter, the relay pipe 116 turns upward to draw the yarn end YB to guide it to the piecing sections 114.

Upwardly of the piecing sections 114 is provided a yarn guide 117 for guiding the upper yarn YA guided downward from the suction mouth 115, and downwardly of the piecing sections 114 is provided an upper yarn separator 118 for separating a middle portion of the upper yarn YA into left and right two single yarns Y1 and Y2 to guide them to the left and right piecing sections 114. Upwardly of the cutter 108 is provided a lower yarn separator 119 for separating a middle portion of the lower yarn YB into two left and right single yarns to guide them to the left and right piecing sections 114.

Figure 6:
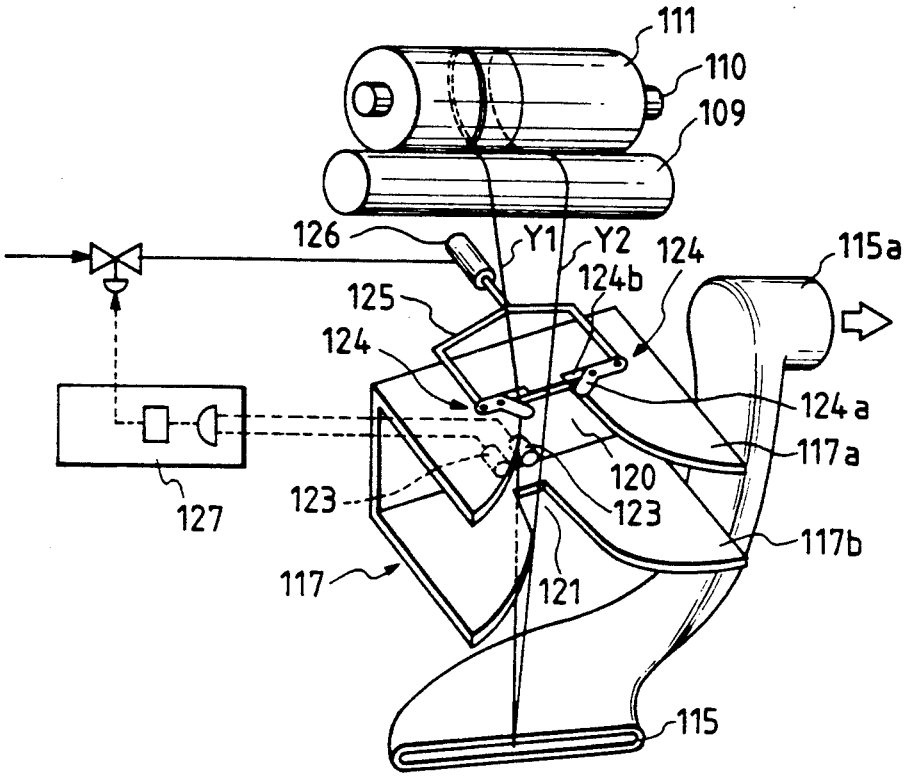
FIG. 6 is a perspective view of the important parts in FIG. 5.

The yarn guide 117 has two guide members 117*a* and 117*b* vertically spaced apart from each other as shown in FIG. 6, and both the guide members 117*a* and 117*b* are formed with guide grooves 120 and 121 each having a width to allow traverse of the yarn YB traversed by the traverse drum 9 which is reversed at the time of drawing, said guide grooves 120 and 121 being forwardly spread. The width of the lower guide member 117*b* is formed to be narrower than that of the upper guide member 117*a*. A pair of sensors 123 are disposed facing to both sides of the narrow guide groove 121 to detect whether or not the drawn yarn is divided into two sections. The sensors 123 are formed of photosensors or the like.

On the other hand, on opposite sides of the upper guide groove 120 are provided a pair of cutters 124 for cutting one yarn Y1 which precedes by traversing at the time of drawing a yarn. Both the cutters 124 are each composed of a fixed blade 124*a* and a rotatable blade 124*b*, both the movable blades 124*b* being simultaneously driven by a common air cylinder 126 through an actuating arm 125.

In order to cut only one yarn Y1 which precedes by the traversing by the cutter 124, a controller 127 for inputting output signals of both the sensors 123 is set so that when two yarns Y1 and Y2 are simultaneously detected, an electromagnetic valve 128 for an air cylinder 126 is opened to actuate the cutter 124 after a lapse of a predetermined time till the other yarn Y2 is moved away from the cutter 124.

The controller 127 is further set so that the traverse drum 109 is reversed in order to reversely rotate the winding package 111 once after the cutter 124 has been actuated, and thereafter the drawing operation of the yarn end YA by the suction mouth 115 is carried out again. In the case where the sensor 124 does not sense separated yarn, the piecing, that is, piecing such as separation of the upper yarn YA by the upper yarn separator 118 is continuously carried out.

Next, the operation of the embodiment will be described. In the operating state of the doubler 101, when at least one yarn sensor 105 senses the yarn breakages of the yarns Y1 and Y2, the cutter 108 is actuated to cut the yarn Y. Thereby, an inconvenience such that only one single yarn is wound on the winding package 111 is prevented.

After the cutter 108 has been actuated, the piecing apparatus 112 starts the piecing operation. First, the suction mouth 115 turns upwardly from the standby position and moves close to the winding package 111, at which time the winding package 111 is reversed and the suction mouth 115 sucks the yarn end A from the winding package 111, and the suction mouth 115 turns downward to guide the yarn end to the piecing sections 114 while drawing the upper yarn YA from the winding package 111. When the downward turning of the suction mouth 115 is terminated, the reversal of the winding package 111 stops.

In the case where a suction mouth 115 sucks the yarn end YA from the surface of the yarn layer of the winding package 111 which reversely rotates for yarn end finding, normally two yarns Y1 and Y2 in a state in which the yarns are doubled into a single yarn are sucked into the suction mouth 115. However, there is a case where due to fuzz entanglement, after one yarn Y1 has been first sucked suction of the other yarn Y2 is delayed by one or several periods (FIG. 6 shows a state in which two yarns are deviated by one period).

When the yarn is drawn in the state where separation of yarn with period deviation occurs in the yarn YA drawn out of the winding package 111, the two sensors 23 simultaneously detect the two separated yarns Y1 and Y2. Then, the cutters 124 are actuated by the controller 127 at time after the lapse of predetermined time, as shown in the time chart of FIG. 7, so that the two cutters 24 simultaneously perform a cutting operation.

In this case, both the yarns Y1 and Y2 are subjected to traversing as the drum 109 reverses. One of the yarns Y1 which precedes by said time delay t1 sufficiently moves closer to one of the cutters 124, and the succeeding other yarn Y2 is sufficiently moved away from the other cutter 24. Therefore, even if both of the cutters 124 are actuated, only one preceding yarn Y1 is to be cut.

Figure 7:
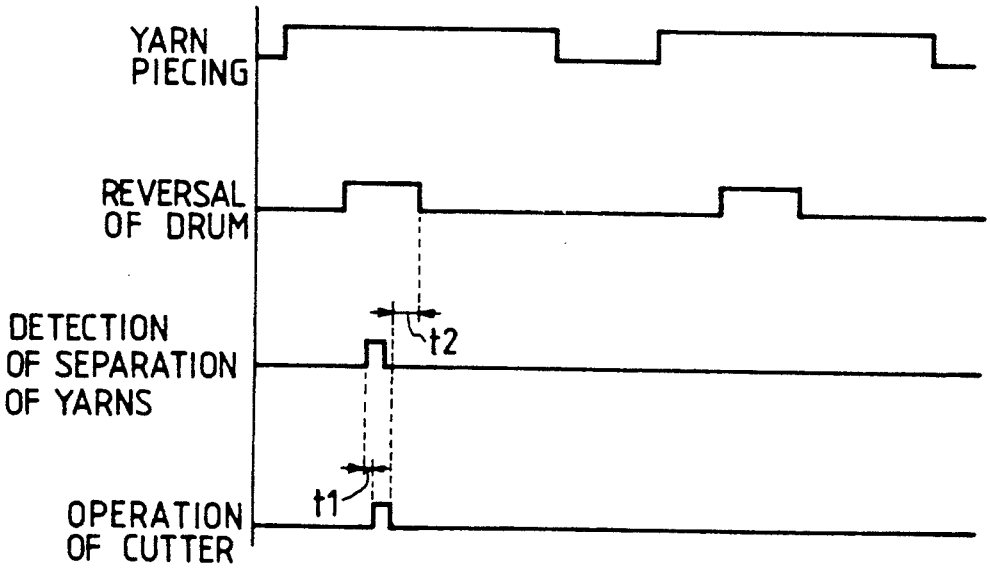
FIG. 7 is a view showing timing of operation.

During that period, the traverse drum 109 reversely rotates, as shown in FIG. 7, and stops its reversal at time t2, after a lapse of one rotation of the winding package 111 after the actuation of the cutters 124. The uncut yarn Y2 is drawn by one rotation of the winding package 111, whereby a deviation of one period between the two yarns Y1 and Y2 is overcome.

Next, the drawing operation of the yarn end YA by the turning of the suction mouth 115 is again carried out, and this time, the two yarns Y1 and Y2 are arranged into a single yarn. If separation of yarns caused by period deviation does not occur, the piecing is continued.

That is, in a case where the yarn YA that is drawn out of the winding package 111 by the suction mouth 115 is arranged into a single yarn, the sensors 123 do not simultaneously detect two yarns Y1 and Y2. Therefore, the cutter 124 is not actuated, and the upper yarn separator 118 is actuated to separate the two single yarns Y1 and Y2 constituting the upper yarn YA into left and right sections, each yarn being guided either to the left or the right piecing sections 114. In this case, the sensor 123 simultaneously detects two single yarns Y1 and Y2 but the cutter 124 is not actuated in this step or stage. Then, the relay pipe 116 turns downward from the standby position to suck the two lower yarns YB prepared in the yarn guide 106 portion and turns upward to guide the yarns to the piecing sections 114. Then, the lower yarn separator 119 is actuated to separate the lower yarn YB into left and right sections, and the yarns Y1 and Y2 are guided to the left or right piecing sections 114. The upper yarn YA and the lower yarn YB are pieced together by the piecing sections 114, after which the operation of the doubler 101 is re-started.

In a case where two yarns Y1 and Y2 are deviated by several periods, the drawing operation is carried out several times, and when two yarns Y1 and Y2 are arranged into a single yarn, the piecing is to be continued.

In short, according to the piecing method of the present invention, where separation of yarns with period deviation occurs when the yarn end is drawn out of the winding package by the suction mouth, the period deviation is overcome so that two yarns can be arranged into a single yarn and drawn, thus enabling normal piecing.

In a doubler in which two yarns are merely passed through and doubled at a collecting guide, yarns to be doubled are merely arranged, and the mere passage of two yarns through the collecting guide as described leads to a disadvantage in that separation of yarns tends to occur. The arranged yarns are once wound on the package and twisted by the double twisting machine. Therefore, the yarns released from the package in the double twisting machine are smoothly guided by use of a flyer so as to be free from occurrence of separation of yarns. However, since this flyer is positioned above the double twisting machine, this comprises an obstacle during operation of the piecing apparatus in case of automation, and in addition, extra work for threading to the flyer is necessary.

In view of the foregoing, the present invention provides a doubling nozzle for performing doubling without separation of yarns by entangling fibers on the surfaces of two arranged yarns.

The entangling nozzle for doubling two yarns comprises a yarn passage hole having a guide member for guiding two yarns in a contact state and parallel with each other, a contact portion for two yarns positioned close to an inner wall surface of said yarn passage hole, and an air nozzle positioned on an imaginary plane perpendicular to said inner wall surface to blow out high pressure air. The yarn passage hole has a circular cross section or a V-shaped cross section. A semispherical recess is provided at a position of the yarn passage hole facing to the air nozzle.

In the entangling nozzle for doubling according to the present invention, when two yarns pass through the entangling nozzle, they travel parallel with each other through the air guide having the circular inner wall surface in section, and during that period, high pressure gas is blown out of the air nozzle toward the contact portion of both yarns. Then, the high pressure gas vertically impinges upon the circular inner wall surface of the air guide. As a result, the impinged high pressure air is divided into two directions so that two yarns are reversely rotated and twisted while being divided to place them in a twisted state. This yarn is untwisted when the former passes through the entangling nozzle and returned to its original state. Therefore, when the yarns are rotated in the direction opposite to that previously effected and untwisted, both the yarns become firmly entangled because ends of fibers projected from the surface of the yarns become entangled with each other.

Embodiments of the doubling and twisting nozzle will be described with reference to the drawings.

Figure 8:
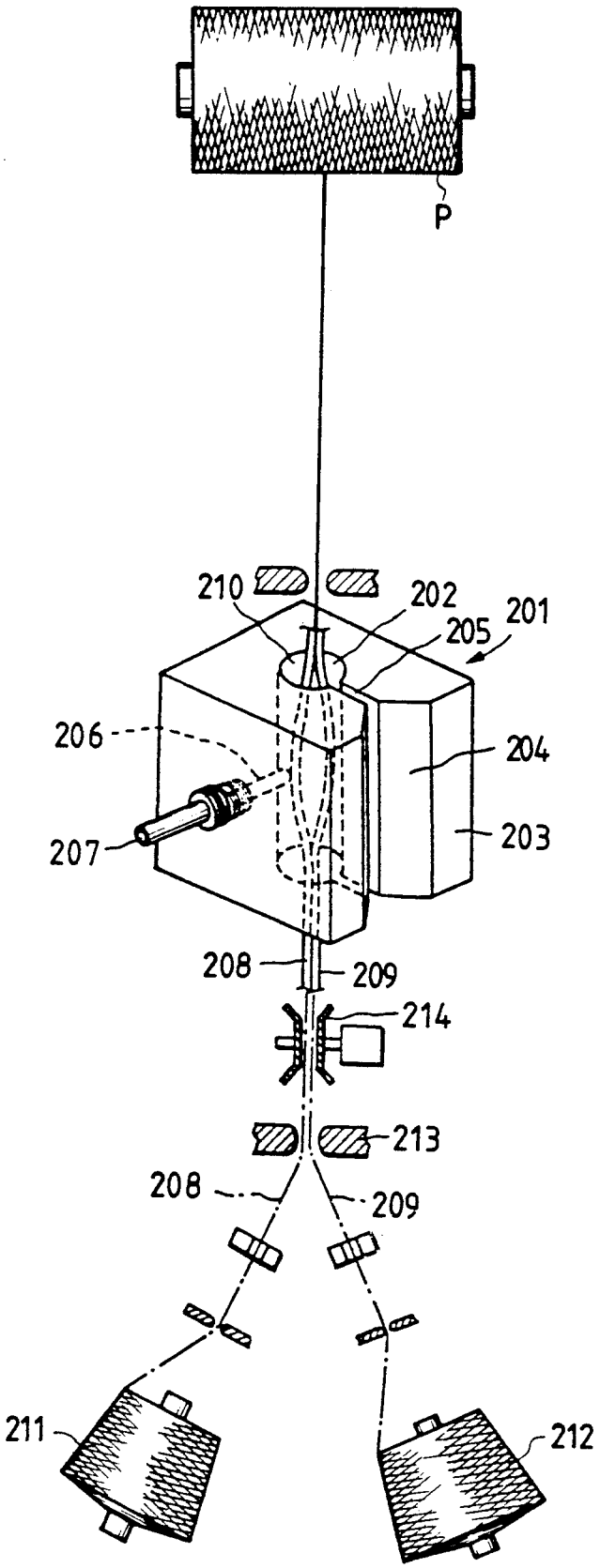
FIGS. 8 to 10 show a first embodiment of an entangling nozzle for doubling of the present invention, FIG. 8 being a perspective view, FIG. 9 being a cross sectional view of the entangling nozzle, and FIG. 10 being a side view showing the state of twisting of yarns.
Figure 9:
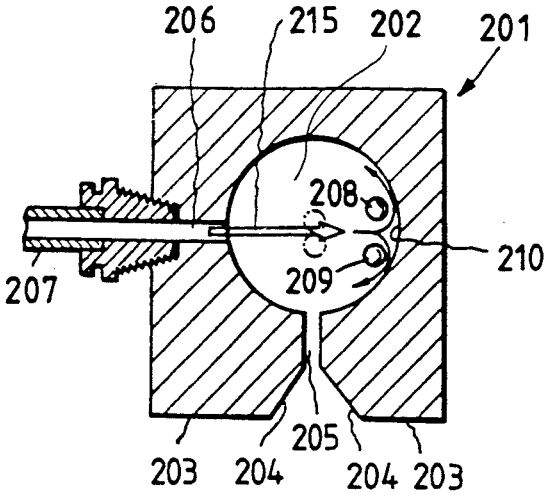
Figure 10:
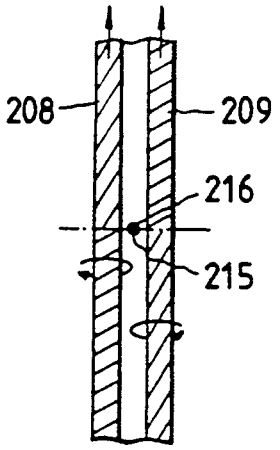

FIGS. 8 and 9 show a first embodiment of the nozzle. A yarn entangling nozzle 201 is provided with a yarn passage hole 202 which vertically extends therethrough at the center. On one side 203 of the entangling nozzle 201 is provided a slit 205 provided at an opening with a yarn guide surface 204 and communicated with the yarn passage hole 202, and on the side adjacent to the side 203 is provided an air nozzle 206 for blowing out high pressure air. This air nozzle 206 is communicated with an external high pressure air source by means of a pipe 207, directed at a contact portion of two parallel yarns 208 and 209 guided into the yarn passage hole 202, and directed vertically to an inner wall surface 210 of the yarn passage hole.

In use of the entangling nozzle 201, the yarns 208 and 209 drawn out of two packages 211 and 212 are made to pass through a yarn guide 213 and a tensor 214, and thereafter the yarns are guided into the yarn passage hole 202 through the slit 205 from the guide surface 204 of the entangling nozzle 201. At that time, two yarns 208 and 209 are positioned substantially at the center of and parallelly adjacent to the yarn passage hole 202 of the circular inner surface.

From the aforesaid state, the yarns 208 and 209 are wound. The yarns 208 and 209 are caused to travel and the high pressure air is blown out of the air nozzle 206. Then, the center of an air flow 215 is directed at the contact portion of the yarns 208 and 209 to urge the yarns 208 and 209 against the inner wall surface 210 of the yarn passage hole 202 and the yarns vertically impinge upon the inner wall surface 210, the yarns being evenly separated to left and right sections. The yarns 208 and 209 are divided into left and right sections by the air flow 215 to rotate the yarns 208 and 209 in the direction opposite to each other. At this time, the yarns 208 and 209 are divided into the twist side and untwist side vertically from the center 216 of the air flow 215. That is, on the lower side from the center 216, the yarn 208 is rotated in the same direction as the twist of the yarn 208 and therefore it is rotated in the twisting direction whereas on the upper side, it is rotated in the untwisting direction. Since the yarns 208 and 209 are twisted in the same direction, the lower side from the center 216 of yarn 209 rotated in the untwisting direction whereas the upper side is rotated in the twisting direction with the result that they are reversed to each other from the yarn 208. Accordingly, when both the yarns 208 and 209 having passed through the yarn passage hole again assume the state adjacent to each other, return-rotation of the twisting and untwisting occurs so that fuzz projected from the yarn surfaces become entangled to obtain a firmly contacted doubled yarn.

Figure 11:
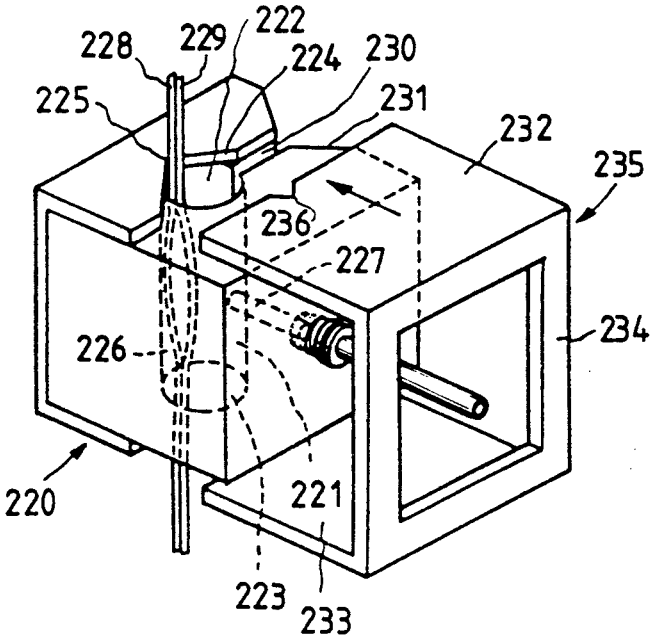
FIGS. 11 and 12 show a second embodiment of an entangling nozzle for doubling of the present invention, FIG. 11 being a perspective view showing the state in which a gathering plate is removed, and FIG. 12 being a longitudinal sectional view of an entangling nozzle.
Figure 12:
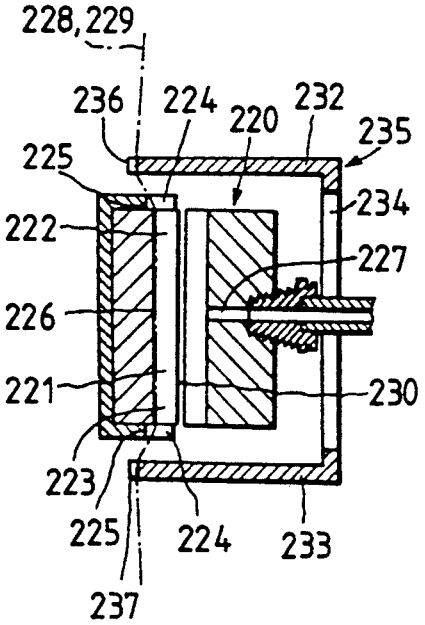

In a second embodiment shown in FIGS. 11 and 12, V-shaped guides 224 are provided in upper and lower openings 222 and 223 of a yarn passage hole 221 which vertically extends through an entangling nozzle 220. A deep portion 225 of the V-shaped guide 224 is positioned to be deeper than an inner wall surface 226 of the yarn passage hole 221, and an opening thereof is directed at an air nozzle 227 for blowing high pressure air against the inner wall surface 226 of the yarn passage hole 21. The entangling nozzle 220 is provided with a slit 30 for introducing yarns 228 and 229 and a guide surface 31 of openings 222 and 223, similarly to the previous embodiment. Yarn gathering plates 232 and 233 are provided so as to cover the openings 222 and 223 and are connected by a connecting portion 234 to constitute a ] -shaped gathering member 235. The gathering member 235 is positioned, in use, directed at the V-shaped guide 224 as shown in FIG. 12, and notches 236 and 237 for guiding the yarns 228 and 229 are provided at the position corresponding to the deep portion 225 of the V-shaped guide 224. The bottom of the notches 236 and 237 is positioned externally of the inner wall surface 226 of the yarn passage hole 230 whereby the yarns 228 and 29 extending through the yarn passage hole 221 are bent as shown in FIG. 12, and the yarns are urged against the inner wall surface 226 of the yarn passage hole 221 positioned at the deep portion 225 of the V-shaped guide 225 by the notches 236 and 237 of the yarn gathering member 235.

In use, the yarn gathering member 235 is deviated from the openings 222 and 223 as shown in FIG. 11 and the yarns 228 and 229 have been passed through the slit 230, after which the yarn gathering member 235 is returned to the position as shown in FIG. 12 and the yarns are bent as described above. As the result, the yarn is urged against the inner wall surface 226 of the yarn passage hole 221 positioned at the deep portion 225 of the V-shaped guide 224. As the result, the contact portion of the yarns 228 and 229 is positioned on the center line of the air nozzle 227. When in that state the high pressure air is blown out of the air nozzle 227, the yarns 228 and 229 are reversely rotated by the operation similar to that of the first embodiment, and the yarns 228 and 229 having passed through the entangling nozzle become firmly entangled with each other.

Figure 13:
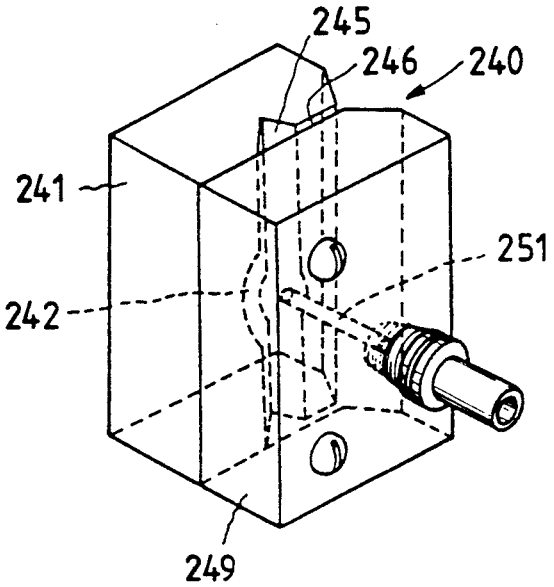
FIGS. 13 to 15 show a third embodiment of an entangling nozzle for doubling of the present invention, FIG. 13 being a perspective view, FIG. 14 being a longitudinal sectional view of an entangling nozzle, and FIG. 15 being a cross sectional view thereof.
Figure 14:
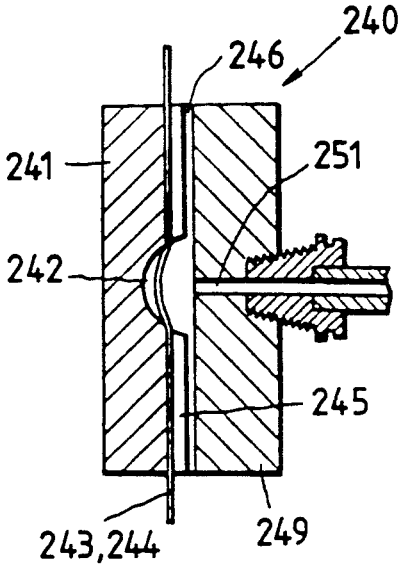
Figure 15:
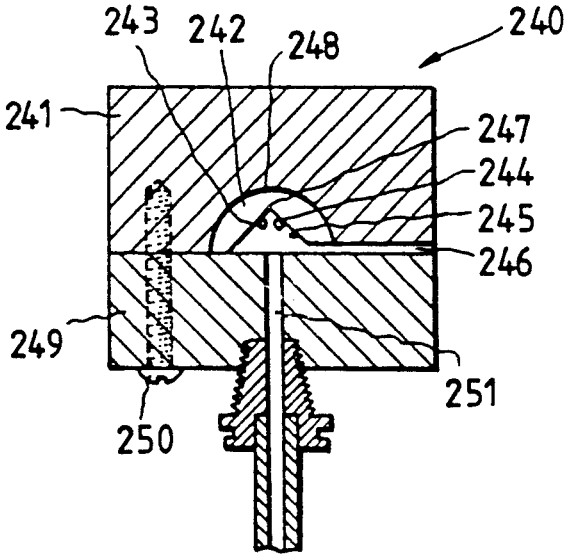

In a third embodiment shown in FIGS. 13 to 15, an entangling nozzle 240 is divided into two sections, and a first member 241 on one side thereof is formed with a yarn passage hole 242 in the form of a semisphere. Yarn guides 245 each having a V-shape in section are provided at upper and lower portions thereof to guide yarns 243 and 244, the yarn guide 245 being formed with a slit 246 for threading the yarns 243 and 244 from the side. A deep portion 247 of the V-shaped yarn guide 245 is not deeper than a deepest portion 248 of the semispherical yarn passage hole 242 so that the yarns 243 and 244 passing through the V-shaped yarn guide 245 will not contact the semispherical deepest portion 248. A second member 249 is fixed at screw 250 so as to cover the semispherical yarn passage hole 242 and the opening of V-shaped yarn guide 245. This second member 249 is provided with an air nozzle 251 so as to be directed at the center of the semispherical yarn passage hole 242.

In use, the yarns 243 and 244 entered into the yarn guide 245 form the slit 246 are positively positioned at the center of the air flow from the air nozzle 251 and positively rotated in the direction opposite to each other by the air flow. At that time, since the yarns 243 and 244 are not urged against the inner surface of the yarn passage hole 242, the fuzz of the yarns 243 and 244 are not crushed and in addition, the action to produce fuzz on the surfaces of the yarns 243 and 244 is created to promote entanglement of the yarns 243 and 244, thus obtaining a firm doubled yarn.

According to these embodiments of the present invention constructed as described above, in the entangling nozzle, two yarns are rotated reversely to each other, and when the rotation is returned after having passed through the entangling nozzle, the yarns are entangled with each other to enable obtaining a firm doubled yarn which is hard to be separated. Accordingly, when this yarn is applied to a double twisting machine, no separation of yarns occurs during travel. Therefore, a flyer need not be used, comprising no obstacle to the operation of the piecing apparatus. In addition, the double throwing machine can be easily automated.

What is claimed is:

1. A method for drawing a yarn in a doubler, comprising:

rotating a winding package in an unwinding direction, drawing and traversing a doubled yarn end from the winding package using a suction force, detecting whether the doubled yarn end drawn from the winding package is divided into a first traversing yarn and a second traversing yarn, cutting the first traversing yarn, stopping the rotation of the winding package in the unwinding direction after at least one revolution of the winding package in the unwinding direction and after cutting the first traversing yarn, and repeating the step of drawing the doubled yarn end from the winding package.

2. A method for piecing a yarn in a doubler, comprising:

rotating a winding package in an unwinding direction, drawing and traversing a doubled yarn end from the winding package using a suction force, detecting whether the doubled yarn end drawn from the winding package is divided into a first traversing yarn and a second traversing yarn, cutting the first traversing yarn, stopping the rotation of the winding package in the unwinding direction after at least one revolution of the winding package in the unwinding direction and after cutting the first traversing yarn, repeating the step of drawing the doubled yarn end from the winding package, separating the doubled yarn end drawn from the winding package into a first yarn and a second yarn, drawing a doubled yarn end from a yarn feeding package, separating the doubled yarn end drawn from the yarn feeding package into a first yarn and a second yarn, piecing the first yarn drawn from the winding package and the first yarn drawn from the feeding package, and piecing the second yarn drawn from the winding package and the second yarn drawn from the feeding package.

* * * * *